US006776741B2

(12) United States Patent
Burwell

(10) Patent No.: US 6,776,741 B2
(45) Date of Patent: Aug. 17, 2004

(54) WEIGHT EXERCISE APPARATUS

(75) Inventor: Jerry J. Burwell, Cardiff, CA (US)

(73) Assignee: HT&R Sports LLC, Cardiff by the Sea, CA (US)

( * ) Notice: Subject to any disclaimer, the term of this patent is extended or adjusted under 35 U.S.C. 154(b) by 0 days.

(21) Appl. No.: 10/039,217

(22) Filed: Jan. 3, 2002

(65) Prior Publication Data

US 2003/0125169 A1 Jul. 3, 2003

(51) Int. Cl.[7] ..... A63B 21/072
(52) U.S. Cl. ..... 482/108; 482/106; 482/107
(58) Field of Search ..... 482/93–98, 106–108

(56) References Cited

U.S. PATENT DOCUMENTS 4,076,236 A * 2/1978 Ionel ..... 482/108
4,453,710 A * 6/1984 Plotz ..... 482/107
4,529,197 A * 7/1985 Gogarty ..... 482/107
4,566,690 A * 1/1986 Schook ..... 482/108
4,638,994 A * 1/1987 Gogarty ..... 482/107
4,913,422 A * 4/1990 Elmore et al. ..... 482/106
5,024,434 A * 6/1991 Smith ..... 482/107
5,090,693 A * 2/1992 Liang ..... 482/108
5,222,930 A * 6/1993 Bold, Jr. ..... 482/132
5,464,379 A * 11/1995 Zarecky ..... 482/108
5,628,716 A * 5/1997 Brice ..... 482/106
5,871,423 A * 2/1999 Pruchnik ..... 482/110
5,911,651 A * 6/1999 Liu ..... 482/108
6,592,499 B2 * 7/2003 Parker ..... 482/106

* cited by examiner

*Primary Examiner*—Nicholas D. Lucchesi
*Assistant Examiner*—Fenn C Mathew
(74) *Attorney, Agent, or Firm*—Gordon & Rees LLP

(57) ABSTRACT

An improved weight exercise apparatus having an interlocking grip bar and rotationally removable weight plates. A weight plate is attached to a socket on the grip bar and can be interlocked with additional weight plates using a simple insert and twist motion. The grip bar does not extend beyond the attached weight plates making the apparatus ergonomically friendly and aesthetically pleasing. The invention restricts the movement of interlocked weight plates to limit rattle-type noise typical of loose weights on a barbell and includes a latching mechanism to prevent a weight plate from being accidentally disconnected.

21 Claims, 8 Drawing Sheets

Un-Latched Position

WEIGHT EXERCISE APPARATUS

FIELD OF THE INVENTION

The present invention relates to an adjustable weight apparatus with modular interlocking components.

BACKGROUND OF THE INVENTION

The practice of exercising with weights is well known, and is commonly used to increase the strength and tone of muscles in the body. As such, the fitness equipment market has a preponderance of barbells, dumbbells, and other types of weight resistance equipment.

When exercising with weights, it is often desirable to change the amount of weight being used during an exercise program. A variety of fixed weight equipment is available, but a suitable selection of such equipment requires a lot of room for use and takes a good deal of space for storage.

Adjustable weight equipment is also available where weights may be added or removed from an apparatus. The process for changing weights, however, is often complicated and time consuming. For example, as described in U.S. Pat. No. 4,529,197, weight changes are made by removing and replacing a protruding locking collar on a grip bar each time weights are added or removed. In addition to being time consuming, the procedure may require a special tool, and can be difficult to implement.

In other types of adjustable equipment, weights are changed using a threaded connector as described, for example, in U.S. Pat. No. 5,464,379. Threaded connectors have several disadvantages. They may bind, become difficult to remove, and require tightening, which is dependent on the strength of the user. In addition, the weights may become loose during an exercise and may even dislodge from the bar member, causing distraction or injury.

Some types of apparatus have the bar or grip of a barbell or dumbbell extending beyond the weight plates, creating equipment that is larger than necessary and tending to restrict the full movement of wrists and arms.

In addition, most weight exercise equipment is fabricated primarily with metal parts, which tends to increase the manufacturing cost and the final cost to the consumer.

Accordingly, there is a need to provide an improved adjustable weight exercise apparatus that is functional, easy to use, safe from accidental disconnects, ergonomically friendly, and cost-effective.

BRIEF SUMMARY OF THE INVENTION

The invention provides an improved weight exercise apparatus comprising an interlocking grip bar assembly and weight plate assembly that can be used to form dumbbells, barbells and similar types of weight exercise equipment.

Weight plates of the apparatus of the invention can be added and interlocked with previously attached weight plates using a simple insert and twist motion. Accordingly, the process of changing weights does not require the removal of any collars, clamps, or similar holding devices.

In addition, no protruding bar is exposed at the ends of the apparatus, and the outer faces of the weight plates are flat, making the assembly safe, easy to use, and aesthetically pleasing.

When weight plates are interlocked to each other on the grip bar assembly, the invention provides for minimal clearances between parts, limiting any "mechanical play" between weight plates and reducing any "rattle noise", typical of loose plates on a barbell.

One embodiment of the invention includes a spring or flexible material to further minimize movement between parts.

Each weight plate assembly of the invention includes a locking mechanism to provide safety from an accidental disconnect of a weight plate from the grip bar, or from an adjacent plate.

As a further safeguard against accidental disconnection, when weight plate assemblies are attached to each other, each plate covers the locking mechanism of the adjacent plate, preventing the locking mechanism from being deactivated. This feature of the invention also ensures that additional weights cannot be added to the assembly unless previously added weights are firmly locked in place.

The modular, interlocking, components of the invention can be fabricated by blending molded parts with metal parts, to make the assembly cost effective, attractive, and functional.

The novel interlocking features and safeguards of the invention are adaptable to exercise equipment, sporting goods, and to other types of apparatus where removable interlocking elements are required.

DETAILED DESCRIPTION OF THE INVENTION

Figure 1:
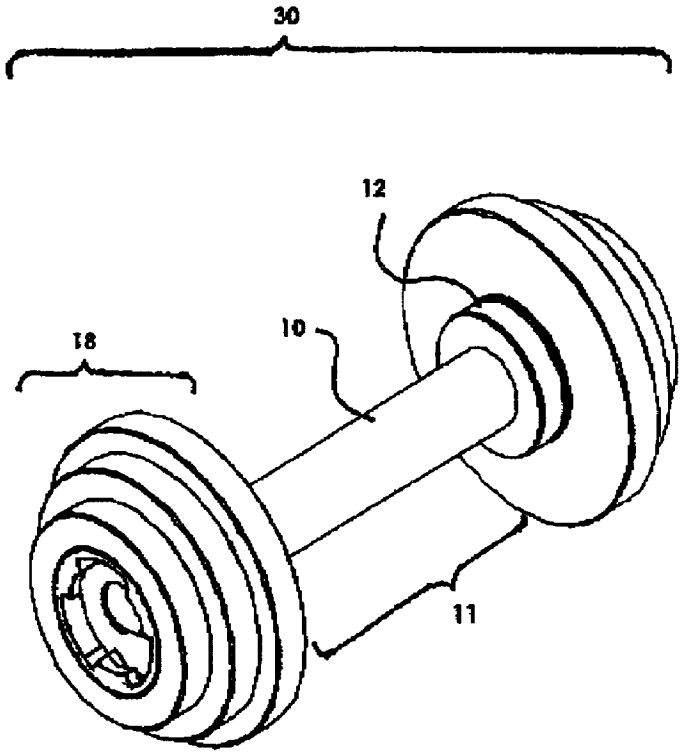
FIG. 1 is a perspective view of an apparatus of the invention.

With reference to FIG. 1, a weight exercise apparatus 30 of the invention comprises an interlocking grip bar assembly 11 and one or more weight plate assemblies 18.

The grip bar assembly 11 includes a bar or handle 10 having two ends, and a socket 12 at each end of the bar to which a weight plate assembly 18 may be attached.

In a preferred embodiment of the invention, the bar 10 of the grip bar assembly 11 is cylindrical in shape and of a convenient diameter to be easily grasped by hands.

Figure 2:
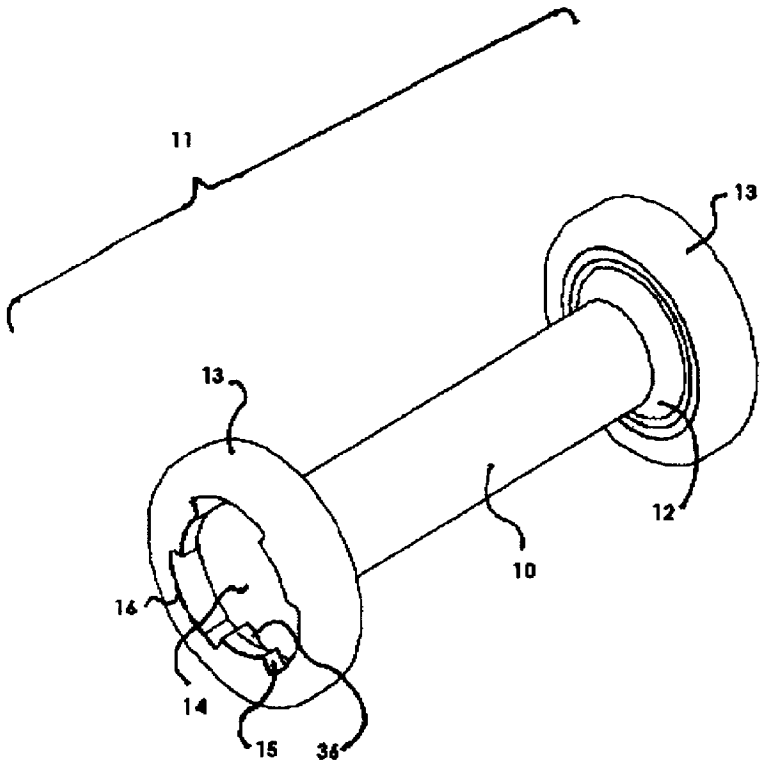
FIG. 2 is a perspective view of the grip bar assembly of the invention.

As shown in FIG. 2, each bar socket 12 comprises a housing 13 with a cylindrical cavity 14 having a bayonet-type flange 15 with two or more radially spaced cutouts 16 and one or more stop-position shoulders 36 configured to rotationally engage corresponding bayonet-type tabs of a weight plate assembly. Although a ring-shaped housing is shown, the housing may have other shapes including, but not limited to, square or rectangular formats.

Figure 3:
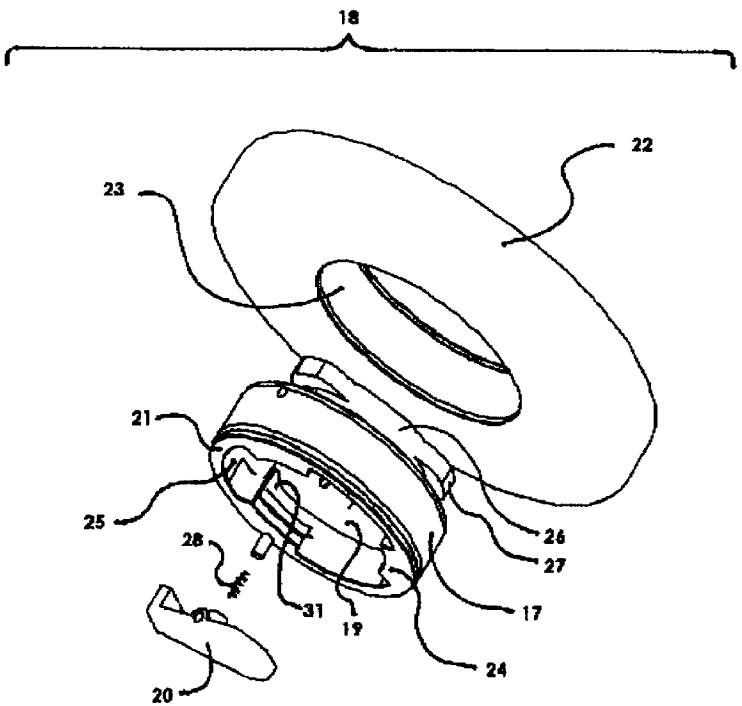
FIG. 3 is an expanded view of the weight plate assembly of the invention.

With reference to FIG. 3, each weight plate assembly 18 has a disc-shaped weight ring 22 with a central core 23, and an interlocking insert hub 17, adapted to fit into the core 23.

Although a disc-shaped weight ring is shown, a weight plate may have other shapes, including but not limited to square or rectangular formats, without detracting from the functionality of the invention.

The insert hub 17 of the weight plate assembly 18 is cylindrically shaped with a receiving receptacle 21 on one end and a mating connector 26 on the other end. The receiving receptacle 21 has an internal cavity 19 with a circular bayonet-type flange 24.

The flange 24 has two or more radially spaced cutouts 25, and one or more stop-position shoulders 31, adapted to rotationally engage a mating bayonet-type connector.

In a preferred embodiment of the invention, the flange 24 has three equally spaced cutouts.

The mating connector 26 of the insert hub 17 has two or more protruding bayonet-type tabs 27, adapted to be received by the cutouts 16 of the bar socket 12 of the grip bar assembly 11 of the invention, as shown in FIG. 2, or by the receiving receptacle of another weight plate assembly.

The receiving receptacle and the mating connector of the insert hub are designed so that a user may connect two weight plates or a grip bar and a weight plate quickly and easily.

When attaching weights to the grip bar assembly, the bayonet tabs of the insert hub of a weight plate assembly are inserted into the cutouts of the bar socket flange and rotated to a stop position shoulder in the socket cavity, creating an interlock so that the devices cannot be separated until a reverse rotation is applied.

The hub and bar socket of the invention are designed so that accurate alignment of the bayonet tabs of the hub and the socket flange cutouts is not necessary, making the assembly ergonomically friendly to normal hand and wrist movements.

Similarly, when adding additional weights to a weight plate assembly, the bayonet tabs of the insert hub of the added weight plate assembly are inserted into the flange cutouts of the receiving receptacle of the existing weight plate assembly and rotated to a stop position shoulder, creating an interlock, so that the weight plates cannot be separated until a reverse rotation is applied. This exemplary feature of the invention makes adding or removing weights a quick and easy process.

In order to ensure that weight plates cannot be disconnected accidentally, the invention further includes a locking mechanism to prevent an unintentional reverse rotation of a weight plate assembly.

In a preferred embodiment of the invention, the locking mechanism is actuated automatically when the insert hub of a weight plate assembly is rotated to the proper alignment in a receiving receptacle or socket. Alternatively, the locking mechanism can be adapted to be actuated manually.

Figure 4:
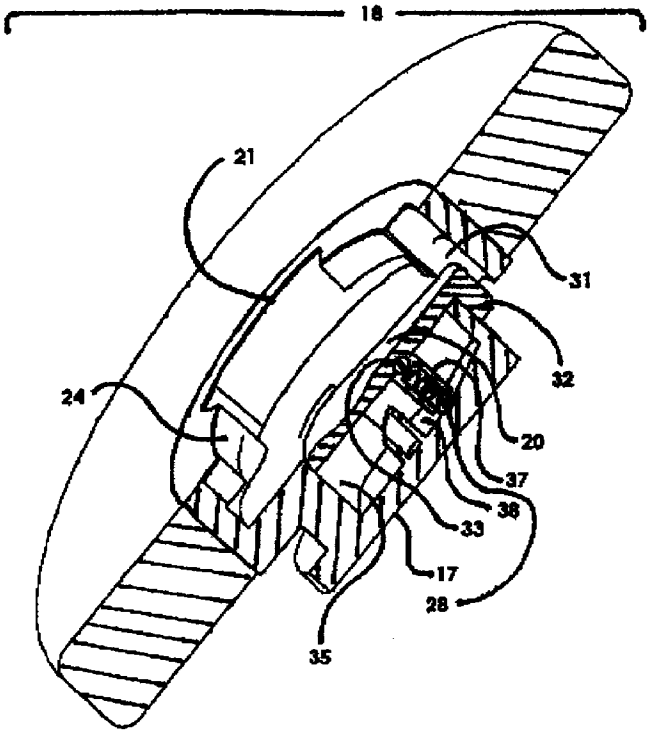
FIG. 4 is a sectional view of the insert hub of the invention.

With reference to FIG. 4, the receiving receptacle 21 of a weight plate assembly 18 includes a locking mechanism cavity 35 containing a locking lever 20. The lever is formed with an L-shaped extension 32 and a pin holder 37. A dowel 33 in said cavity 35 provides for rotational movement of the lever about the longitudinal axis of the dowel.

The pin holder is adapted to contain a movable spring-pin assembly 28 for engaging the bottom surface 38 of the locking mechanism cavity.

Figure 5:
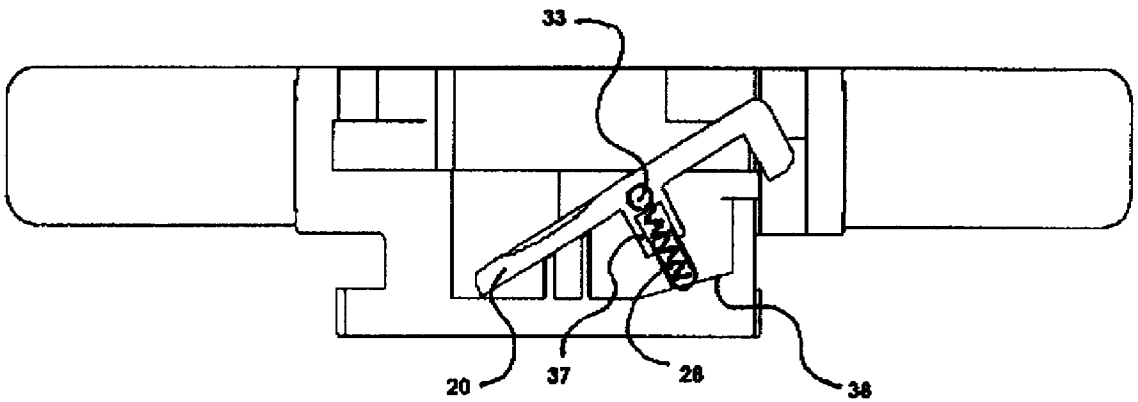
FIG. 5 is an illustrative view of the latching mechanism of the invention.

As shown illustratively in FIG. 5, the spring-pin assembly 28 exerts pressure on the bottom surface 38 of the cavity and on the locking lever 20. The bottom surface of the cavity is preferably ramp-shaped to keep the lever in a desired latched or unlatched position.

As shown in FIG. 4, the locking lever extension 32 protrudes outside the locking mechanism cavity to engage the flange shoulder of an interlocked weight plate assembly whenever the locking lever is in the latched position.

To release the locking mechanism, the locking lever is pushed by a finger or thumb to an unlatched position, to disengage the L-shaped extension from the attached weight plate. The plate can then be rotated in the reverse direction and released from the assembly.

Figure 6:
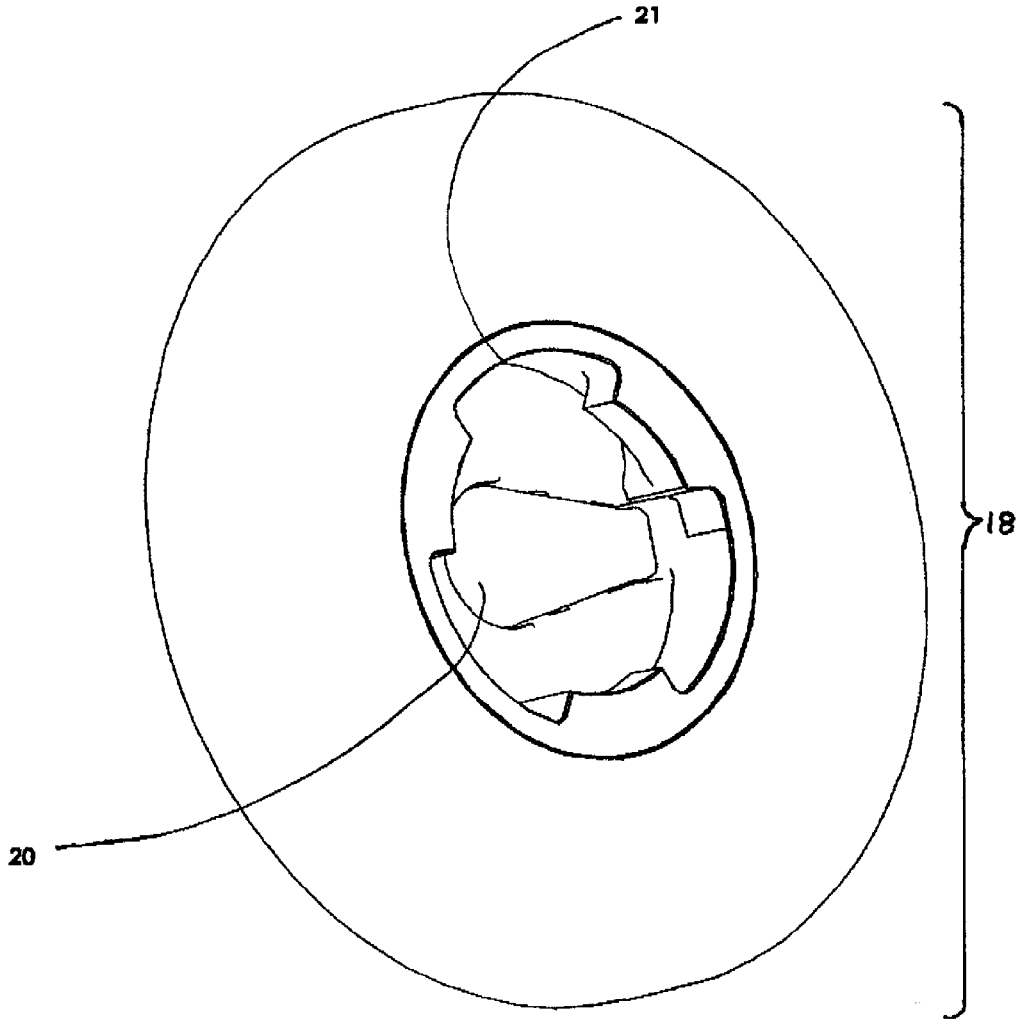
FIG. 6 is a perspective view of the weight plate assembly of the invention.

As shown in FIG. 6, in the latched position, the locking lever 20 is aligned with the locking mechanism cavity in the receiving receptacle 21 of the weight plate assembly 18, thereby permitting the hub of another weight plate assembly to be attached to the receiving receptacle.

Figure 7:
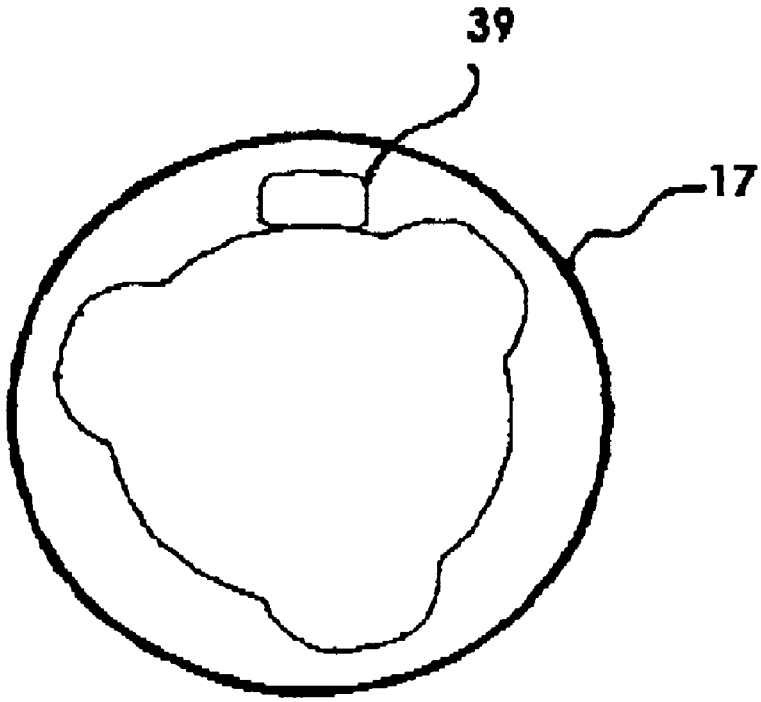
FIG. 7 is a view of the locking lever slot of the invention.

With reference to FIG. 7, the locking lever extension is adapted to protrude through a slot opening 39 in the hub 17 when in the latched position, and clears the slot opening when in the unlatched position.

In operation, to create an interlock between two weight plate assemblies, or between a weight plate assembly and the grip bar assembly of the invention, the bayonet tabs of the weight plate assembly to be attached are first inserted into the cutouts in the flange of the grip bar socket or receiving weight plate receptacle. The attached weight plate is then rotated to the stop position at the shoulder of the flange, creating an interlock. When the two assemblies are in proper alignment, the locking lever is depressed to prevent a reverse rotation of the attached weight plate, maintaining the interlock.

In a preferred embodiment of the invention, as illustrated in FIG. 4, the spring pin assembly 28 can be relocated to a pin holder 39 on the bottom surface 38 of the locking mechanism cavity 35, to provide automatic latching of the locking lever. In this configuration, the spring-pin assembly presses the locking lever extension into the latched position when the attached weight plate is interlocked with a receiving receptacle.

The interlocking elements of the invention can be formed with minimal clearances between parts to limit "mechanical play" and any "rattling noise" of the weight plates.

Figure 8:
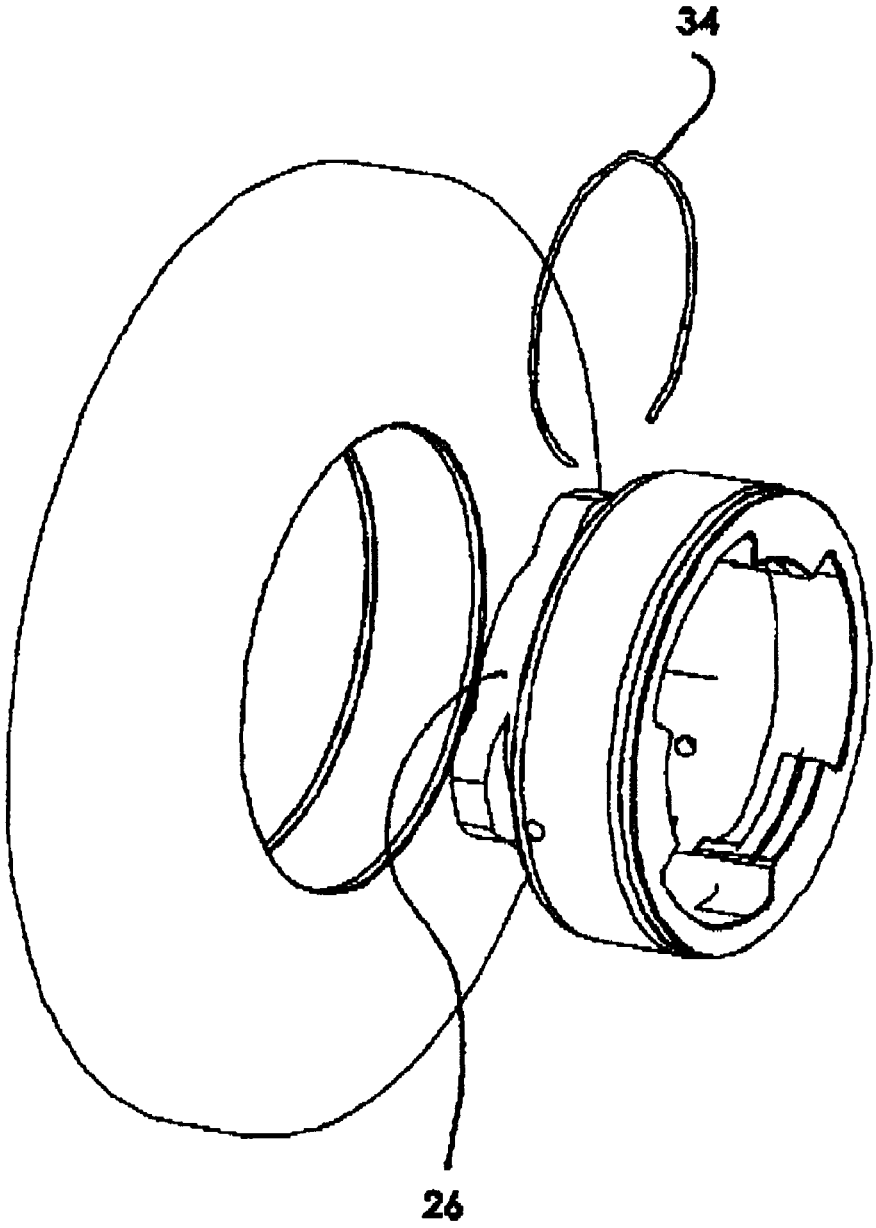
FIG. 8 is a perspective view of the compression spring feature of the invention.

As shown in FIG. 8, a circular compression spring 34 can be added to the insert hub connector 26 to further limit movement between interlocked weight plate assemblies.

The invention is designed to be ergonomically friendly. The grip bar does not extend beyond the attached weight plates and the apparatus can be manufactured with metal and molded parts, so that all surfaces are smooth and rounded, thereby avoiding injury to the body and preventing snagging of other objects.

Although the various features of novelty that characterize the invention have been described in terms of certain preferred embodiments, other embodiments will become apparent to those of ordinary skill in the art, in view of the disclosure herein. Accordingly, the present invention is not intended to be limited by the recitation of the preferred embodiments, but is instead intended to be defined solely by reference to the appended claims.

What is claimed is:

1. A weight exercise apparatus comprising:

a grip bar assembly having a handle with two ends, each end having a socket thereon;

at least one weight plate assembly, said weight plate assembly having a weight ring with an interlocking insert hub mounted substantially about a center axis of said weight ring;

said insert hub having a first side on a first surface of said weight plate assembly and having a second side on a second surface of said weight plate assembly;

said insert hub has a locking mechanism, said locking mechanism having a locked position to prevent the unintentional rotation of said removable weight plate assembly and an unlocked position;

said first side of said insert hub rotationally engageable with either said socket, or with the second side of an insert hub of a similarly configured weight plate assembly; and wherein at least one weight plate assembly is attachable to said socket by engaging said first side of said insert hub with said socket, and one or a plurality of additional said weight plate assemblies are successively attachable to earlier attached weight plate assemblies by rotationally engaging the second side of said insert hub of an earlier attached weight plate assembly, to the first side of an insert hub of a successively attached weight plate assembly.

2. The apparatus of claim 1 manufactured with a combination of metal parts and molded whereby all surfaces are smooth and rounded.

3. The grip bar assembly of claim 1 wherein said handle is a cylindrical bar of a convenient diameter to be easily grasped by hands.

4. The socket of claim 1 wherein said socket and said second side of each insert hub comprise:

a housing having a cylindrically shaped cavity with a bayonet-type flange, said flange having two or more radially spaced cutouts and one or more stop-position shoulders dimensioned to engage corresponding bayonet-type tabs on said second side of each insert hub.

5. The socket of claim 4 wherein said housing is ring-shaped.

6. The removable weight plate assembly of claim 1 wherein said weight ring has a central core with a cylindrical interlocking insert hub.

7. The interlocking insert hub of claim 1 wherein said hub is cylindrically shaped with a projecting mating connector on said first side and a receiving receptacle on said second side;

said projecting mating connector adapted to rotationally interlock with the receiving receptacle of another weight plate assembly and with a socket on the handle of said grip bar assembly.

8. The insert hub of claim 7 wherein said projecting mating connector has two or more bayonet-type tabs and said receiving receptacle comprises a cylindrically shaped cavity with a bayonet-type flange, said flange having two or more radially spaced cutouts and one or more stop-position shoulders.

9. The removable weight plate assembly of claim 1 wherein said locking mechanism in said unlatched position, on an earlier mounted weight plate, will prevent the rotational engagement between the second side of the insert hub of said earlier mounted weight plate and the first side of the insert hub of a later mounted weight plate attempting rotational engagement with said earlier mounted weight plate.

10. The locking mechanism of claim 1 comprising:

a locking mechanism cavity;

a locking lever in said locking mechanism cavity, said lever having a latched and an unlatched position;

a slot opening in said insert hub whereby said lever is adapted to extend through said slot opening when in a latched position to engage the stop shoulder of a grip bar assembly socket; and said removable weight plate thereby prevented from rotation when said locking lever is in said latched position.

11. The locking mechanism of claim 1 comprising:

a locking mechanism cavity;

a locking lever in said locking mechanism cavity, said lever having a latched and an unlatched position; and a slot opening in said insert hub whereby said lever is adapted to extend through said slot opening when in a latched position to engage the stop shoulder of an interlocked weight plate assembly.

12. The insert hub of claim 7 wherein said mating connector includes a circular compression spring to limit movement between interlocked weight plate assemblies.

13. The insert hub of claim 7 wherein said mating connector includes a circular compression spring to limit movement between a grip bar assembly socket and an interlocked weight plate assembly.

14. The locking mechanism of claim 1 wherein said mechanism is automatically actuated when the insert hub of a weight plate assembly is rotated to the proper position in a receiving receptacle or socket.

15. The locking mechanism of claim 10 further comprising:

a locking mechanism cavity bottom surface;

a dowel in said cavity;

an L-shaped extension on said locking lever, said lever adapted to be rotationally oriented about the longitudinal axis of said dowel; and a pin holder attached to said locking lever said pin holder containing a movable spring-pin assembly whereby the spring-pin assembly exerts pressure on the locking lever and the cavity bottom surface to extend the L-shaped extension through said slot opening when the locking lever is in a latched position.

16. The locking mechanism of claim 11 further comprising:

a cavity with a bottom surface;

a dowel in said cavity;

an L-shaped extension on said locking lever, said lever adapted to be rotationally oriented about the longitudinal axis of said dowel; and a pin holder attached to said locking lever, said pin holder containing a movable spring-pin assembly whereby the spring-pin assembly exerts pressure on the locking lever and the cavity bottom surface to extend the L-shaped extension through the slot opening when the locking lever is in a latched position.

17. The cavity of claim 16 whereby said bottom surface is ramp-shaped.

18. The locking mechanism of claim 10 further comprising:

a dowel in said cavity;

a locking mechanism cavity bottom surface;

an L-shaped extension on said locking lever, said lever adapted to be rotationally oriented about the longitudinal axis of said dowel; and a pin holder attached to said cavity bottom surface said pin holder, containing a movable spring-pin assembly whereby the spring-pin assembly exerts pressure on the locking lever to automatically extend the L-shaped extension through said slot opening when said hub is rotated to the proper position in a receiving receptacle.

19. A weight exercise apparatus comprising:

a grip bar assembly having a handle with two ends; and a removable weight plate assembly attachable to at least one of said ends, said weight plate assembly comprising a weight ring with an interlocking insert hub;

said insert hub has a locking mechanism, said locking mechanism having a locked position to prevent the unintentional rotation of said removable weight plate assembly and an unlocked position;

said weight plate assembly engageable to said locked position with said handle on a first side of said weight plate assembly; and at least one additional weight plate assembly attachable to said weight plate assembly on a second side of said weight plate assembly.

20. A method of forming an improved weight exercise apparatus comprising the steps of:

providing an interlocking grip bar assembly having a handle with two ends, each end having a socket thereon;

rotationally interlocking a removable first weight plate assembly having a weight ring with an interlocking insert hub from an unlocked position to a locked position with said insert hub in a locked engagement to at least one of said sockets, and providing an additional socket on said first weight plate assemblies adapted for locked engagement with an insert hub of successively attached weight plate assemblies.

21. A method of forming an improved weight exercise apparatus comprising the steps of:

providing an interlocking grip bar assembly having a handle with two ends each end having a socket thereon;

rotationally interlocking a removable weight plate assembly comprising a weight ring with an interlocking insert hub with a locked engagement of said insert hub to at least one of said sockets; and rotationally interlocking said weight plate assembly to a locked engagement with a second weight plate assembly;

rotationally interlocking said second weight plate assembly to a locked engagement with a third weight plate assembly.

* * * * *